US005415074A

United States Patent [19]

Fields

[11] Patent Number: 5,415,074

[45] Date of Patent: May 16, 1995

[54] SUB-CALIBER INBORE WEAPON FOR TANK CANNONS

[76] Inventor: Phillip R. Fields, 4240 Staghorn Cir., South, Fort Worth, Tex. 76137

[21] Appl. No.: 213,224

[22] Filed: Mar. 15, 1994

[51] Int. Cl.[6] ..... F41A 21/10

[52] U.S. Cl. ..... 89/29; 42/77

[58] Field of Search ..... 89/29, 14.05; 42/77; 102/446

[56] References Cited

U.S. PATENT DOCUMENTS

| | | | |
|---|---|---|---|
| 213,616 | 3/1879 | Bowles | 42/77 |
| 757,790 | 4/1904 | Tasker | 89/29 |
| 4,633,755 | 1/1987 | Bertiller et al. | 89/29 |
| 4,872,390 | 10/1989 | Bertiller et al. | 89/29 |

*Primary Examiner*—David Brown
*Attorney, Agent, or Firm*—Arthur F. Zobal

[57] ABSTRACT

The inbore sub-caliber device has spaced apart front and rear adapter plate members, each of which has an opening formed therethrough. A plurality of spaced apart rods extend between the front and rear adapter plate members to locate the openings in the front and rear adapter plate members in alignment. Support structure is coupled to the rear adapter plate. A gun comprising an elongated barrel and a rear receiver member is secured to the support structure. The barrel is supported in alignment with the openings in the front and rear plate members with at least a portion of the receiver located rearward of the rear plate member and the front end of the barrel located forward of the rear plate member to allow a bullet when fired to pass from the front end of the barrel by way of the opening of the front plate member. The inbore sub-caliber device is adapted to be located in the chamber of a cannon, with the front adapter plate member and the front end of the barrel extending to a forward portion of the chamber and with the receiver member being accessible by way of a breach opening in the cannon for allowing a bullet to be located in the receiver and for firing the gun.

5 Claims, 13 Drawing Sheets

SUB-CALIBER INBORE WEAPON FOR TANK CANNONS

BACKGROUND OF THE INVENTION

1. Field of the Invention

The present invention relates to weaponry for use with tank cannons, in particular, to a device having a smaller caliber than a tank cannon which may be located within the bore of a cannon and fired using the firing system of the cannon.

2. Description of the Prior Art

Tanks are equipped with tank cannons designed to fire large caliber shells a relatively long distance. In conflicts occurring in urbanized terrain the shells fired by a tank cannon may inflict too much damage to structures or tax the population since targets are often too small to be utilized effectively and scattered in close proximity of the non-combatants. Furthermore, in low intensity conflicts the firepower provided by the tank cannon may be greater than necessary to destroy the intended target.

Small caliber devices designed for placement in the bore of a tank cannon have been devised for use with tank cannons. A conventional sub-caliber inbore device which consists of a rifle extending through a used cartridge case has been located in a tank cannon to fire smaller caliber shells than cannon shells through the bore of the cannon. A sub-caliber inbore device located in a tank cannon may be used tactically as a sniper weapon, and therefore, is more useful in urbanized terrain or in low intensity conflicts than the large caliber ammunition typically used in the cannon. Furthermore, the sub-caliber inbore devices are more cost-efficient in urbanized terrain and low intensity conflicts since the devices use less expensive ammunition to resolve the conflicts. Additionally, training exercises using the tank cannon may be conducted more cost-efficiently and in less area using a sub-caliber inbore device and small caliber ammunition.

Accuracy of a sub-caliber inbore device is extremely important if the device is to be used tactically as a sniper weapon. Conventional sub-caliber inbore devices rely solely on use of the cannon boresights to zero and aim the device at a target after the device is located in the cannon. Zeroing the device using the cannon's muzzle boresight is often inexact since the boresight is not designed to zero a weapon located within the cannon bore.

Furthermore, conventional sub-caliber inbore devices are integral units having a firing portion of the device integrally coupled to a gun mount that is adapted to fit within the cannon. A separate device must be used if a different caliber inbore weapon is desired or a different caliber cannon is used. Therefore, multiple devices are required if a conventional sub-caliber inbore device is to be used in cannons of different caliber, or if different calibers of the device are to be provided for use in a single cannon.

SUMMARY OF THE INVENTION

It is, therefore, an object of the invention to provide a sub-caliber inbore device for use in a tank cannon having an inbore boresighting telescopic sight for providing accurate and exact zeroing of the device in conjunction with the tank cannon sights.

It is a further object of the invention to provide a sub-caliber inbore device for use in a tank cannon capable of being adapted to cannons of different caliber.

It is a still further object of the invention to provide a sub-caliber inbore device for use in a tank cannon capable of being adapted to fire ammunition of different caliber.

An inbore sub-caliber device adapted to fit in the chamber of a cannon is provided. The device has spaced apart front and rear adapter plate members, each of which has an opening formed therethrough. A plurality of spaced apart rods extend between the front and rear adapter plate members to locate the openings in the front and rear adapter plate members in alignment. Support structure is coupled to the rear adapter plate. A gun comprising an elongated barrel and a rear receiver member is secured to the support structure. The barrel is supported in alignment with the openings in the front and rear plate members with at least a portion of the receiver located rearward of the rear plate member and the front end of the barrel located forward of the rear plate member to allow a bullet when fired to pass from the front end of the barrel by way of the opening of the front plate member. Means for securing the plate members and the barrel in the chamber of the cannon are provided, with the front adapter plate member and the front end of the barrel extending to a forward portion of the chamber and with the receiver member being accessible by way of a breach opening in the cannon for allowing a bullet to be located in the receiver and for firing the gun.

In one aspect of the invention, the rods are removably secured to the front and rear adapter plate members to allow the front and rear adapter plate members to be interchanged with other front and rear adapter plate members of different size, respectively, so that the device may be adapted to a cannon of different caliber. The support structure is removably coupled to the rear adapter plate as well.

In another aspect of the invention, the gun may be interchanged with a gun having a different caliber.

In yet another aspect of the invention, a telescopic sight is mounted to the barrel of the gun located forward of the rear plate to allow the gun to be zeroed on a target.

The sub-caliber inbore device of the current invention offers distinct advantages. The device may be very accurately zeroed on a target using the telescopic sight of the device in conjunction with the sights of the cannon in which the device is located. Furthermore, the device may be used interchangeably between cannons of different caliber by interchanging the removable front and rear adapter plate members of different diameters. Still further, the device may be modified to fire ammunition of different selected calibers by removably interchanging barrels of different caliber in the device.

DESCRIPTION OF THE PREFERRED EMBODIMENTS

Figure 1:
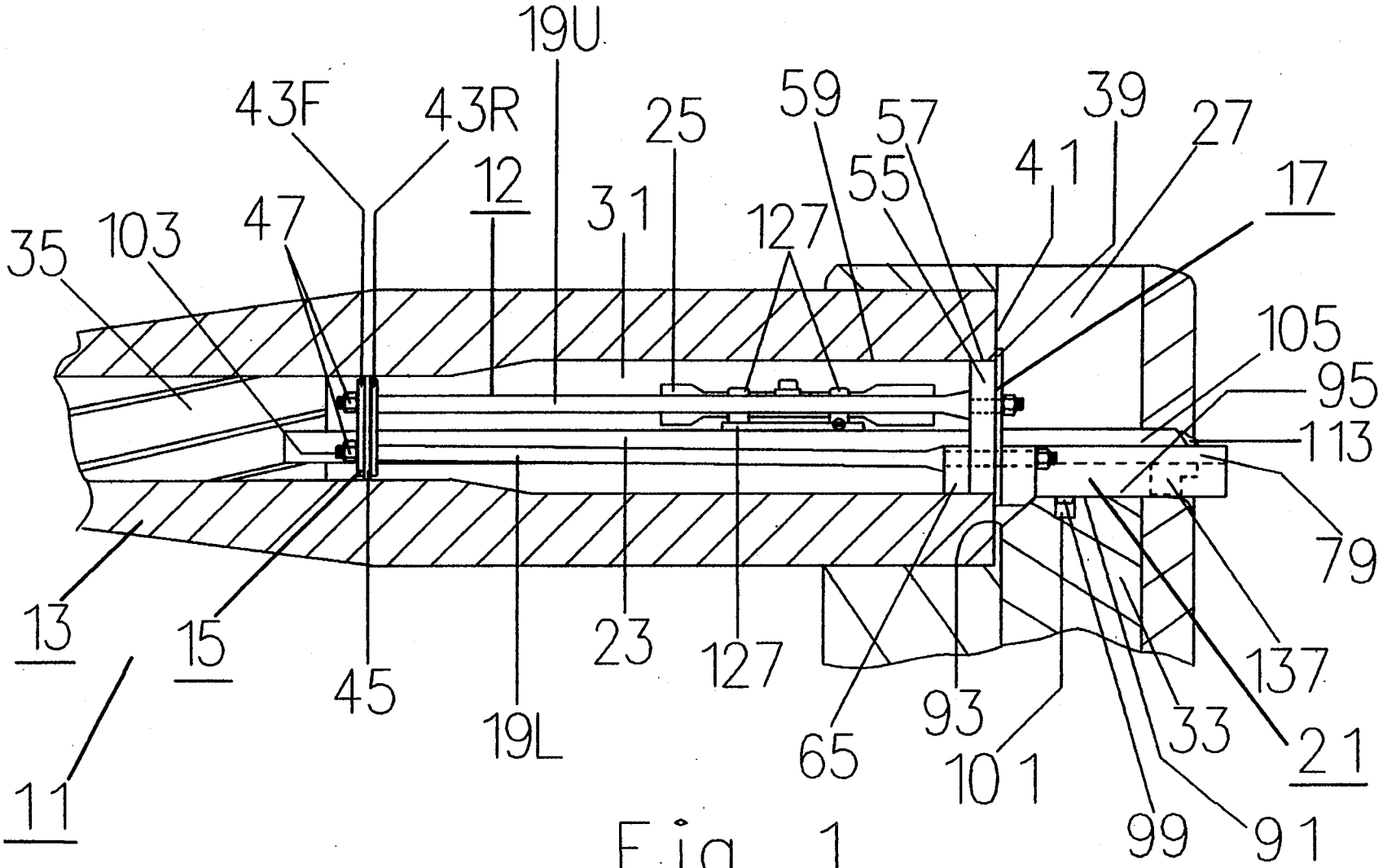
FIG. 1 is a side cutaway view of the sub-caliber inbore device of the present invention located in a tank cannon (the cannon shown in the Figures is a Model M68 used in the M48 Series, M60 Series, and M1 tanks by the U.S. Army).
Figure 2:
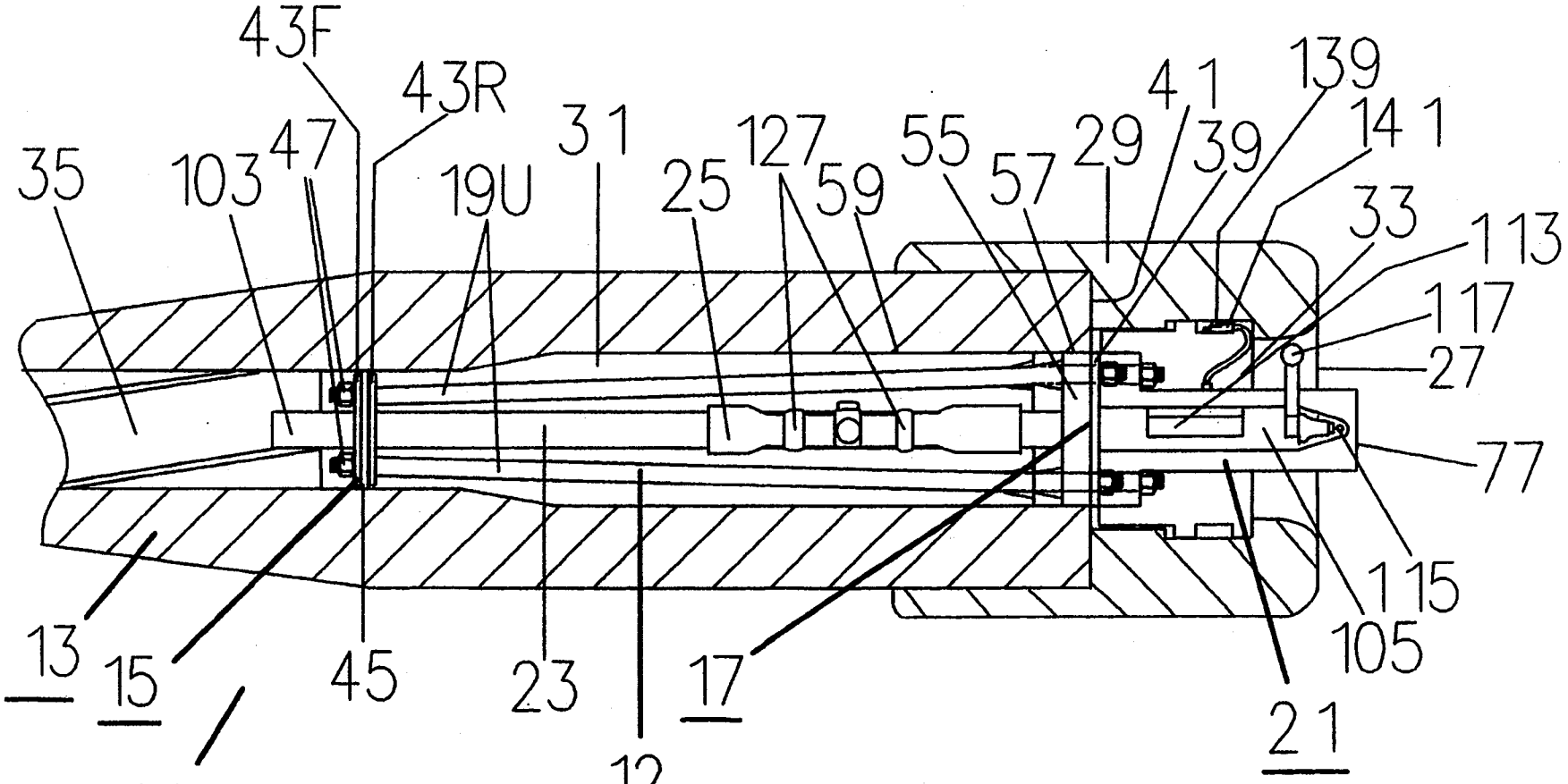
FIG. 2 is a top cutaway view of the device located in a cannon.

Referring now to FIGS. 1 and 2, a side view and a top view of the sub-caliber inbore device 11 of the current invention mounted in a tank cannon 13 is shown. The sub-caliber inbore device 11 fires small caliber shells from the larger caliber cannon 13 using the cannon's fire control and aiming systems. The sub-caliber inbore device 11 can be used tactically in combat as a sniper weapon in low intensity conflicts or in urbanized terrain. Furthermore, use of the sub-caliber inbore device 11 reduces the expense of ammunition and the area required for training exercises using the cannon 13 relative to training exercises conducted with normal cannon ammunition.

Figure 3:
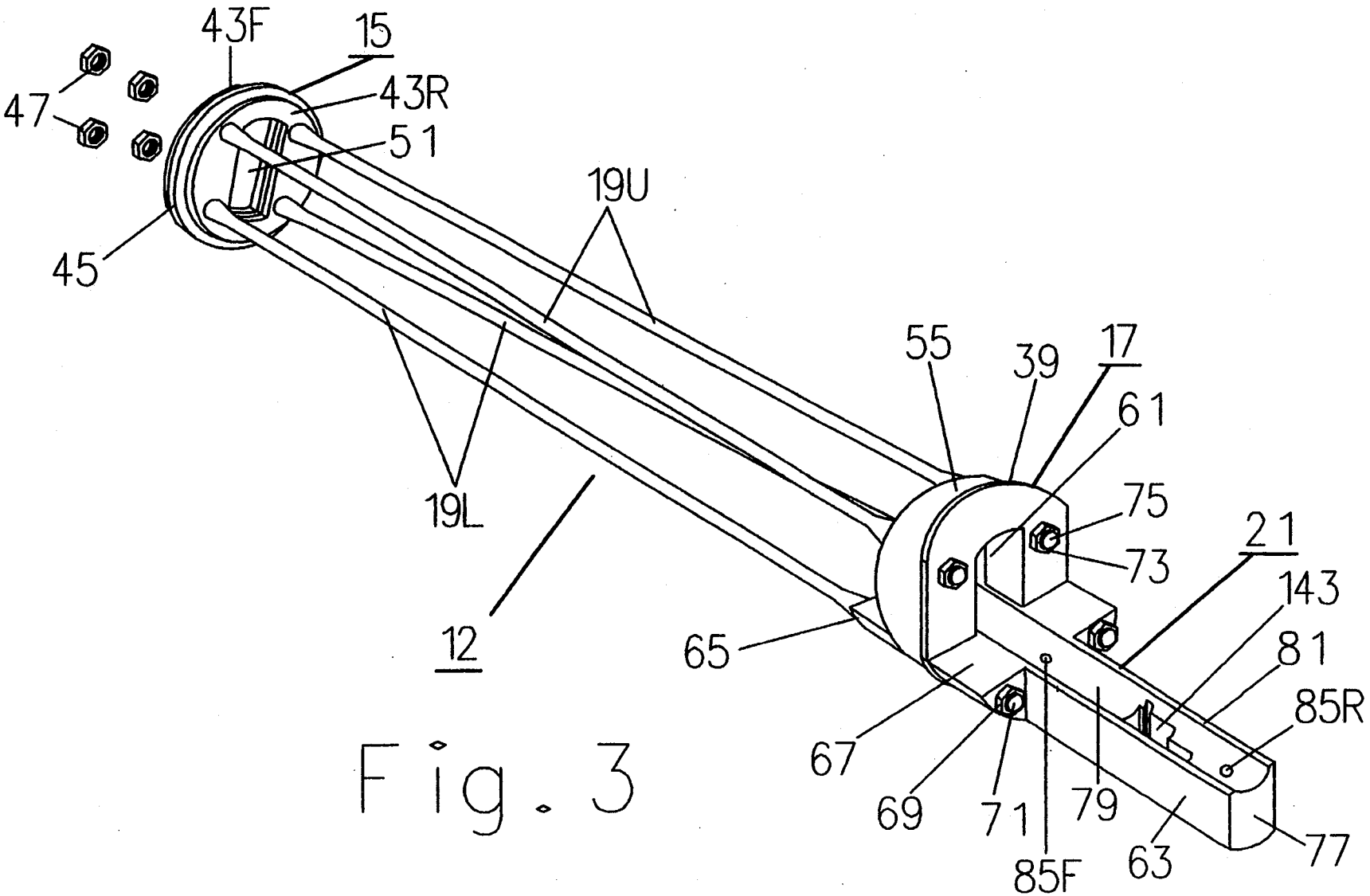
FIG. 3 is a rear isometric view of the frame of the sub-caliber inbore device.
Figure 4:
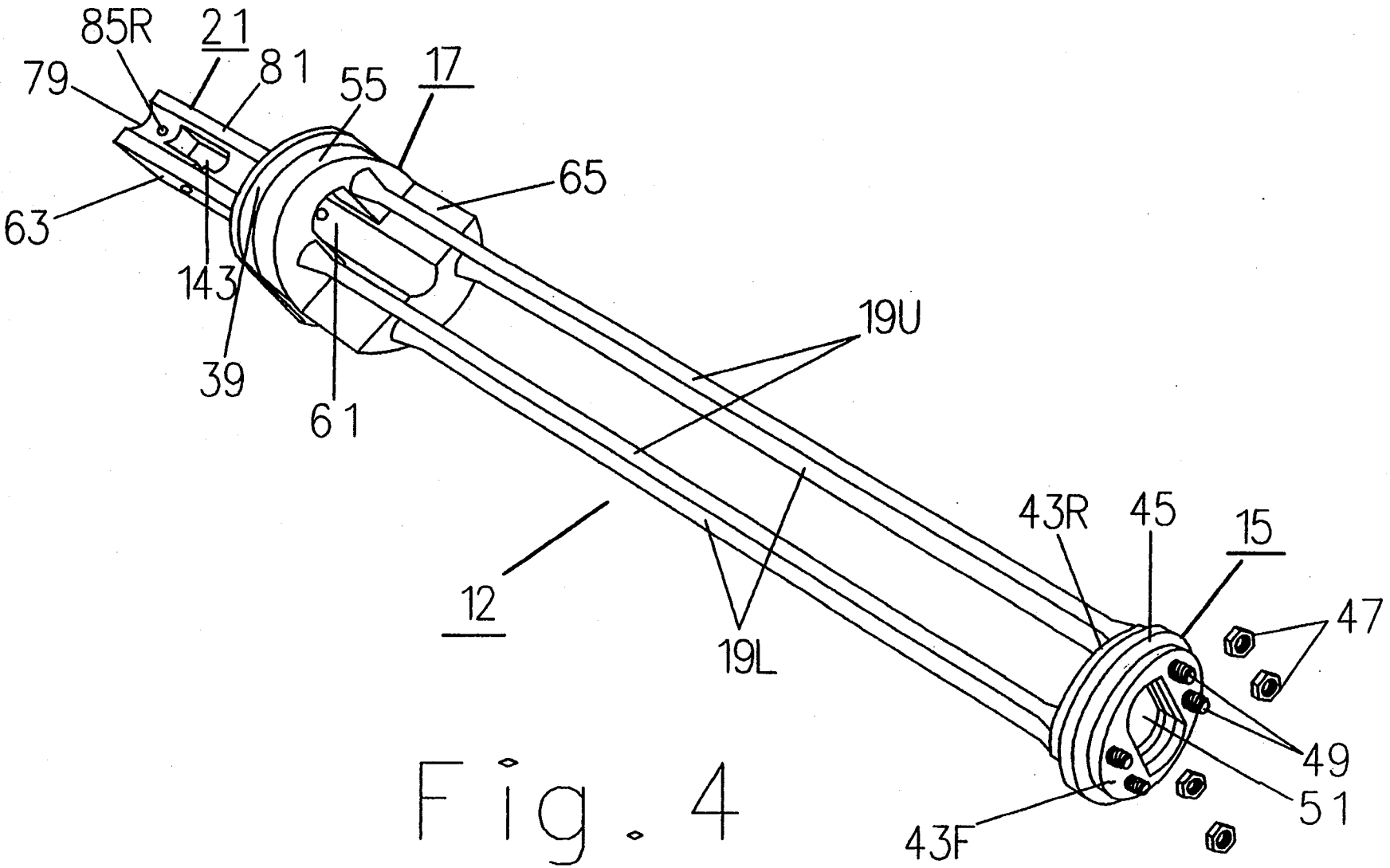
FIG. 4 is a frontal isometric view of the frame of the device.

As shown in FIGS. 3 and 4 the sub-caliber inbore device 11 has a frame 12 which includes a front adapter assembly 15 and a rear adapter assembly 17 coupled together by spaced apart upper and lower adapter rods 19U and 19L which extend between the front and rear adapter assemblies. The frame 12 also includes a breach block stop 21 that is coupled to the rear adapter assembly 17 and extends rearward from the rear adapter assembly. Referring to FIGS. 1 and 2, the frame 12 supports a barrel 23 that is mounted to the breach block stop 21 so that the barrel extends from the breach block stop through the rear adapter assembly 17 and through the front adapter assembly 15 to a location forward of the front adapter assembly. A telescopic sight 25 is mounted along the length of the barrel 23. The barrel 23 and the telescopic sight 25 are located extending between the adapter support rods 19U, 19L.

Figure 8:
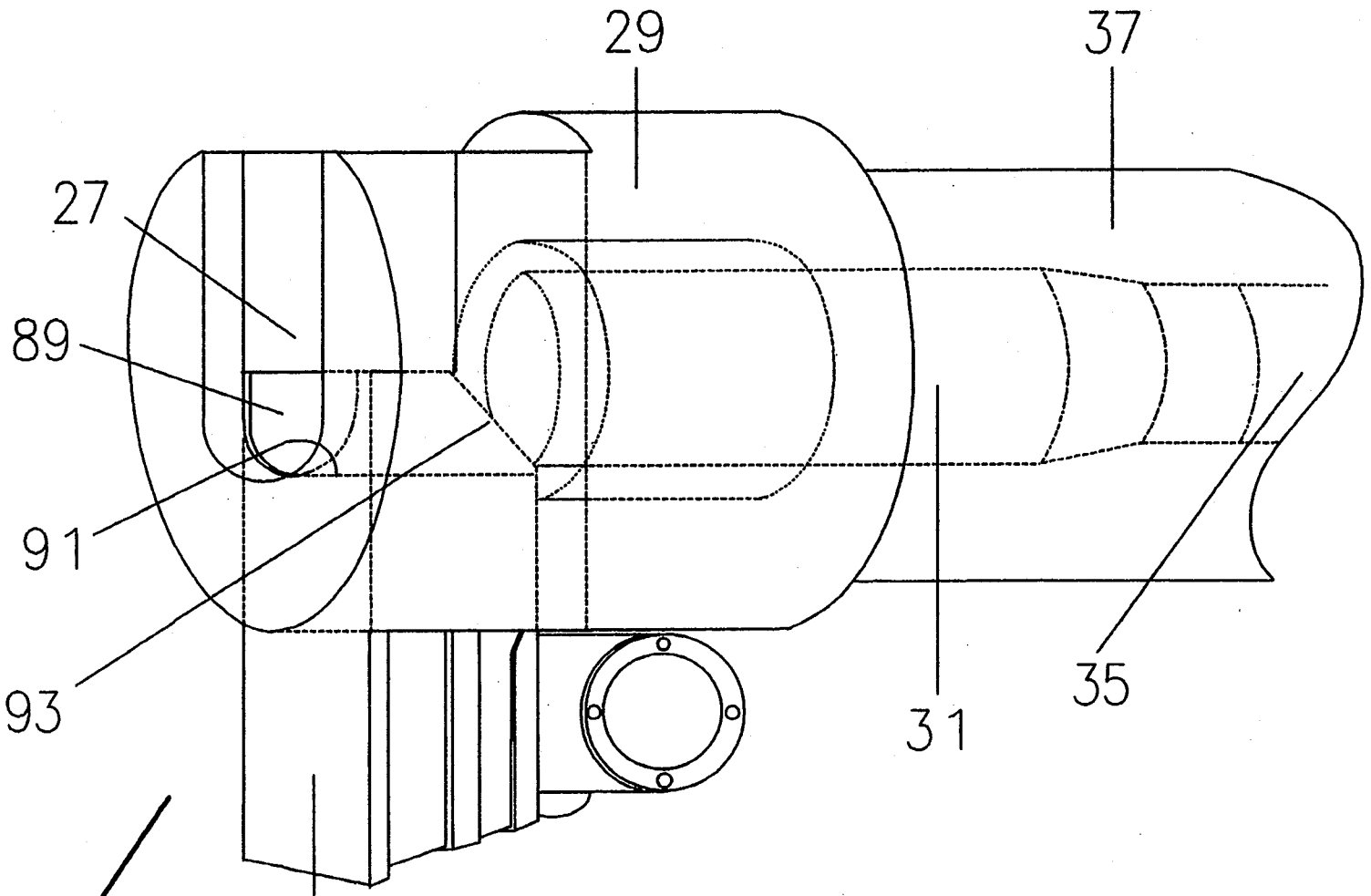
FIG. 8 is a rear isometric view of a cannon into which the device of the present invention may be inserted.

Referring to FIG. 8, a tank cannon 13 with which the device 11 may be used is shown. The cannon 13 has a breach ring opening 27 through which cannon ammunition or the device 11 may be loaded into the cannon 13. The breach ring opening 27 extends through breach ring 29. The cannon ammunition or the device 11 is loaded into the cannon chamber 31. A breach block 33 is located rearward of the chamber 31. The breach block 33 has a downward position extending through the breach ring 29 for allowing access to the chamber 31, and an upward position for sealing the chamber. The breach block 33 is urged towards an upward position by breach block springs. The chamber 31 of the cannon is connected to a rifled bore 35 of the cannon which is coupled to the cannon tube 37. Cannon ammunition or the sub-caliber inbore device 11 located in the chamber 31 is fired from the chamber through the rifled bore 35 and the cannon tube 37 to a target.

As shown in FIGS. 1 and 2, the sub-caliber inbore device 11 is mounted in the chamber 31 of the cannon 13. The front adapter assembly 15 is firmly seated forward in the chamber 31 adjacent the rifled bore 35 of the cannon. The rear adapter assembly 17 is located in the rearward end of the chamber 31, where a flanged portion 39 of the rear adapter assembly is located against a chamber end wall 41 to prevent insertion of the sub-caliber inbore device 11 into the chamber 31 beyond the rear adapter assembly. The breach block 33 is urged upwards against the breach block stop 21 by the breach block springs. The tension of the cannon breach block 33 against the breach block stop 21 forces the rear adapter assembly 17 against the chamber end wall 41 thereby holding the device 11 in the chamber 31.

When the device 11 is held in the cannon by the breach block 33, the barrel 23 extends from the breach ring opening 27 of the cannon 13 through the chamber 31 to the rifled bore 35. The barrel 23 is oriented to fire out of the cannon 13 through the cannon tube 37. The barrel 23 is located on the breach block stop 21 above the breach block 33 in the breach ring opening 27 so that the barrel 23 may be loaded with ammunition through the breach ring opening. The telescopic sight 25 is mounted to the barrel 23 so that the telescopic sight 25 is located within the chamber 31 when the device 11 is located within the cannon 13. The telescopic sight 25 within the chamber 31 of the cannon 13 serves the function of a cannon muzzle boresight to boresight the sub-caliber inbore device 11 to the cannon sights.

Referring now to FIGS. 3–5, and 11, the elements of the frame 12 will now be described in greater detail. The front adapter assembly 15 is comprised of circular front and rear washer plates 43F and 43R and a circular rubber bushing 45 sandwiched between the plates 43F and 43R. The plates 43F and 43R and the bushing 45 are held tightly together by the adapter support rods 19U and 19L and hex nuts 47. The adapter support rods 19U and 19L extend through the plates 43F and 43R and the bushing 45 through spaced apart apertures in the plates and the bushing. The forward ends 49 of the adapter support rods 19U and 19L are located forward of the front washer plate 43F and are threaded to threadably receive the hex nuts 47. The hex nuts 47 are tightened on the threaded ends 49 of the adapter support rods 19U and 19L against the front washer plate 43F to tightly join the front adapter assembly 15 together. A forward barrel aperture 51 is centered extending through the joined plates 43F and 43R and the bushing 45 so that the barrel 23 may be extended through the front adapter assembly 15.

The rubber bushing 45 has a diameter slightly larger than the diameter of the plates 43F and 43R so that a portion of the bushing 45 is exposed outside of the plates 43F and 43R. The exposed portion of the bushing 45 is compressible so that the front adapter assembly 15 may fit tightly into the forward end of the cannon chamber 31. The tight fit afforded by the bushing 45; ensures that the device 11 is maintained in the same position in the chamber 31 by dampening the stress of recoil on the front adapter assembly 15 during firing; compensates for small differences in the chamber dimensions of different cannons caused by wear; and positions the device 11 to the same point of aim and impact each time the device 11 is installed.

The front and rear washer plates 43F and 43R support the bushing 45 and keep the device 11 aligned at the front of the cannon chamber 31. The plates 43F and 43R are formed of a durable material such as steel to provide structural support to the frame 12. The front and rear washer plates 43F and 43R are the same size and have the same pattern of apertures extending therethrough.

The front adapter assembly 15 may be adapted to fit different caliber cannons. Multiple sets of front and rear plates and rubber bushings having diameters corresponding to different caliber cannons may be provided. For example, sets of front and rear plates and bushings may be provided for cannons having calibers of 105 mm, 120 mm and 152 mm. The sets of front and rear plates and rubber bushings are easily interchanged on the frame 12 of the device 11 so that the device will fit a cannon having a particular caliber. The plates and bushing located on the frame 12 may be removed by removing the hex nuts 47 from the adapter support rods 19U and 19L and pulling the adapter support rods 19U and 19L out of the plates and the bushing. A different set of plates and a bushing can then be located on the frame 12.

Figure 6:
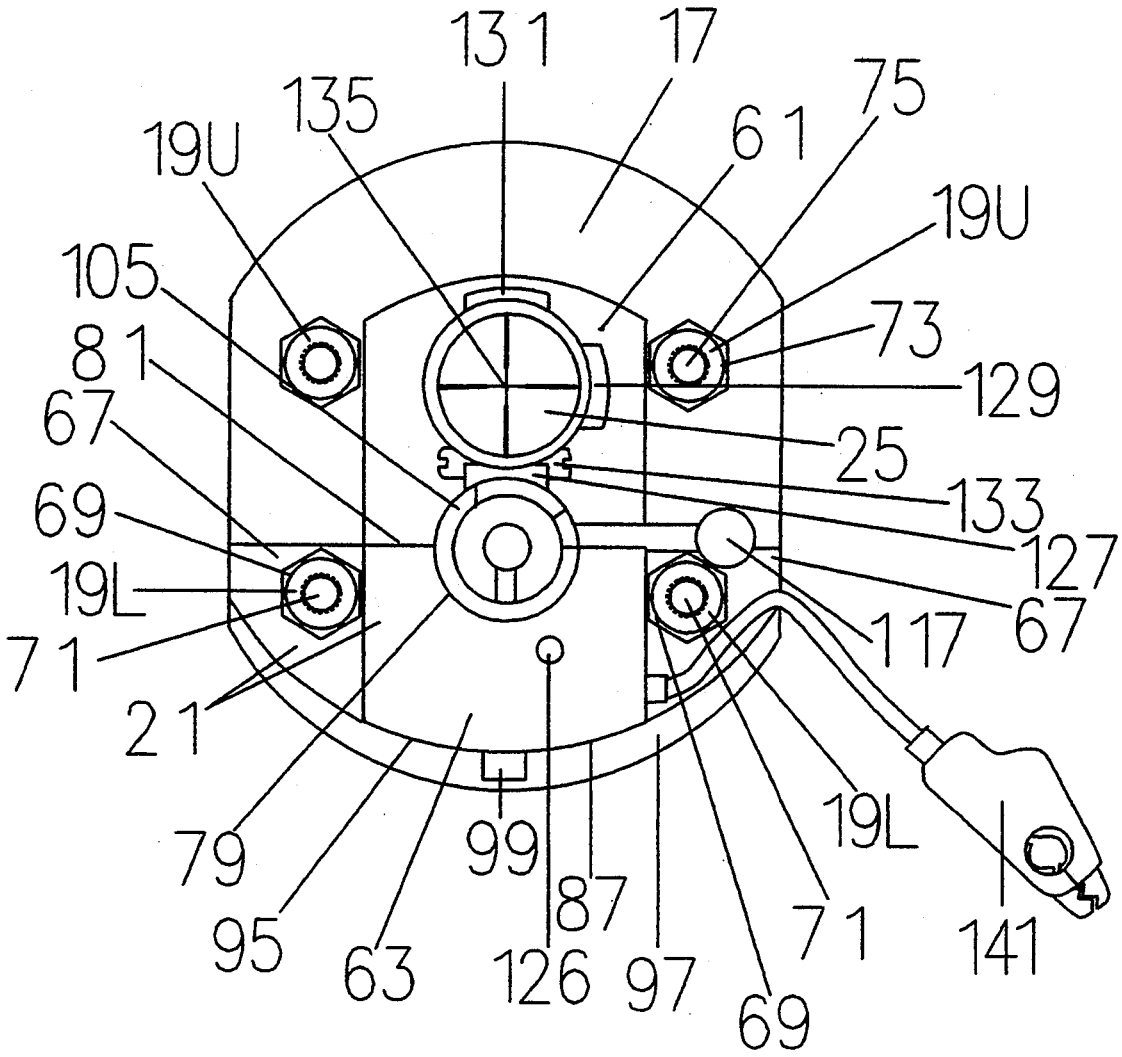
FIG. 6 is a rear view of the device.

The rear adapter assembly is comprised of a C-shaped inbore plate 55 and a flanged portion 39. As shown in FIGS. 1 and 2, the circumference 57 of the inbore plate 55 is located adjacent the inner wall 59 of the chamber 31 at the rear of the chamber. The inbore plate 55 fits snugly into the rear portion of the chamber 31. Inbore plates of different radius may be provided so that the inbore plate may be changed to match the inner dimension of the rear of the cannon chamber so the device 11 may be used with different caliber cannons. As shown in FIGS. 3, 4 and 6, the rear adapter assembly 17 has a rearward barrel aperture 61 extending therethrough so that the barrel 23 may extend through the rear adapter assembly 17.

Figure 5:
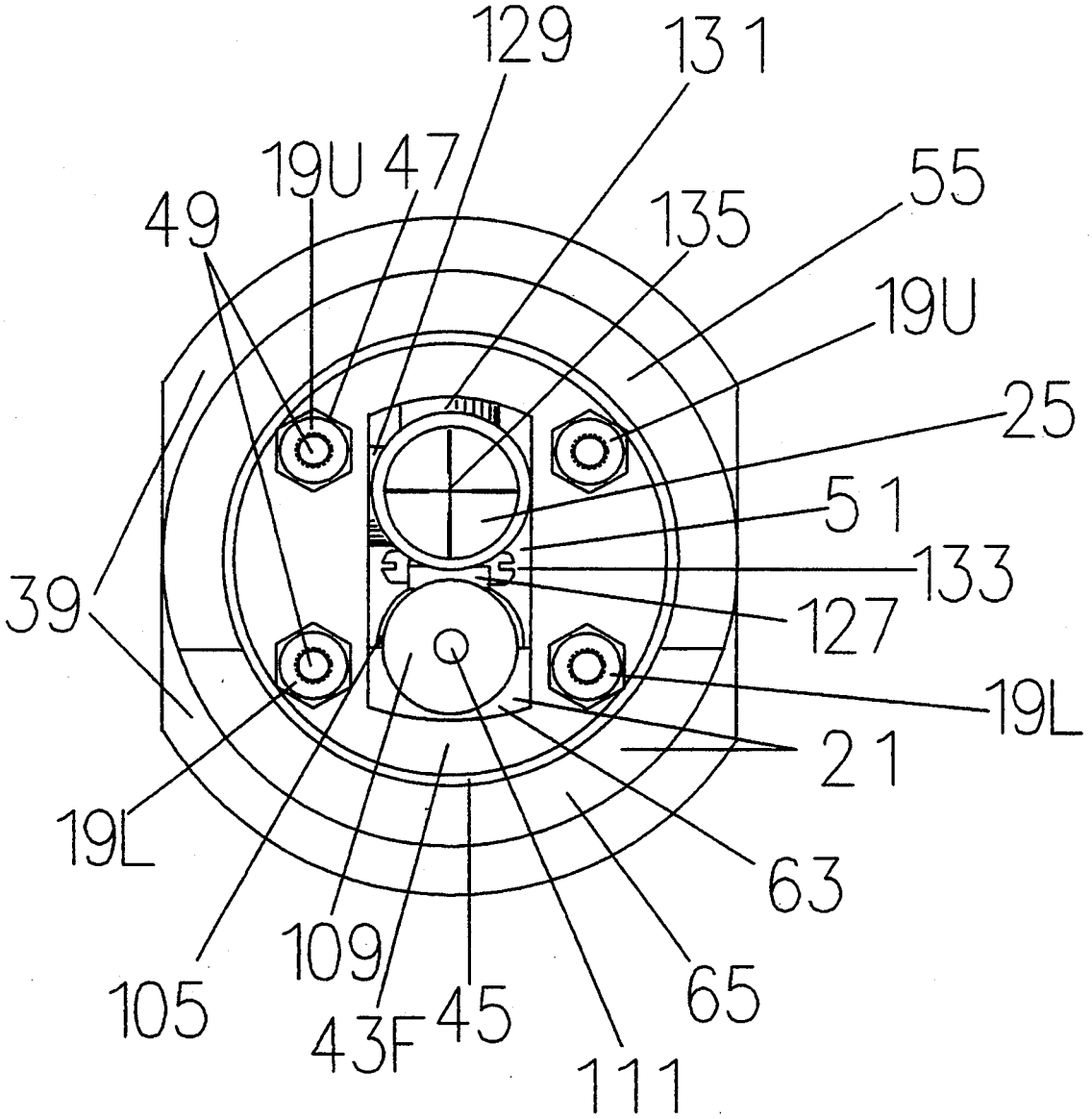
FIG. 5 is a frontal view of the device.

The flanged portion 39 is integrally coupled to the inbore plate 55 at the rear of the plate along a portion of the outside diameter 57 of the plate (See FIGS. 3–5). As shown in FIGS. 1 and 2, the flanged portion 39 extends radially outward from the inbore plate 55 so that the flanged portion 39 engages the end wall 41 of the cannon chamber 31 so as to prevent further insertion of the device 11 into the chamber 31. The rear adapter assembly 17 centers the device 11 in the rear of the cannon chamber 31 and uses the tension of the cannon breach block 33 against the breach block stop 21, which is coupled to the rear adapter assembly, to hold the flanged portion 39 against the end wall 41 of cannon chamber 31 thereby holding the device in the chamber 31.

Referring again to FIGS. 3 & 6, and 12 the lower adapter support rods 19L extend through and couple the inbore plate 55 and the breach block stop 21 together. The breach block stop 21 has a barrel support member 63 that integrally couples and extends between semi-circular inner and outer adapter coupling members 65 and 67 at the forward end of the barrel support member 63. The inbore plate 55 fits partially around the barrel support member 63 between the inner and outer adapter coupling members 65 and 67 so that the barrel support member 63 extends through the inbore plate 55 at the base of the rearward barrel aperture 61. The lower adapter support rods 19L extend through aligned spaced apart apertures 55B in the inbore plate 55 and apertures 65A and 67A in the inner and outer adapter coupling members 65 and 67. Hex nuts 69 are located on threaded rearward ends 71 of the lower adapter support rods 19L tightly coupling the inbore plate 55 between the inner and outer adapter coupling members 65 and 67. The combined C-shaped inbore plate 55 and the semi-circular inner adapter coupling member 65 define a circular member which fits within the bore of the cannon at the rear of the chamber 31.

The upper adapter support rods 19U are secured to the inbore plate 55. The upper adapter support rods 19U extend through spaced apart apertures 55A in the inbore plate 55. Hex nuts 73 are located on threaded rearward ends 75 of the upper adapter support rods 19U. The hex nuts 73 are tightly located against the inbore plate 55 so that the upper adapter support rods 19U are securely fastened between the rear adapter assembly 17 and the front adapter assembly 15.

Figure 12:
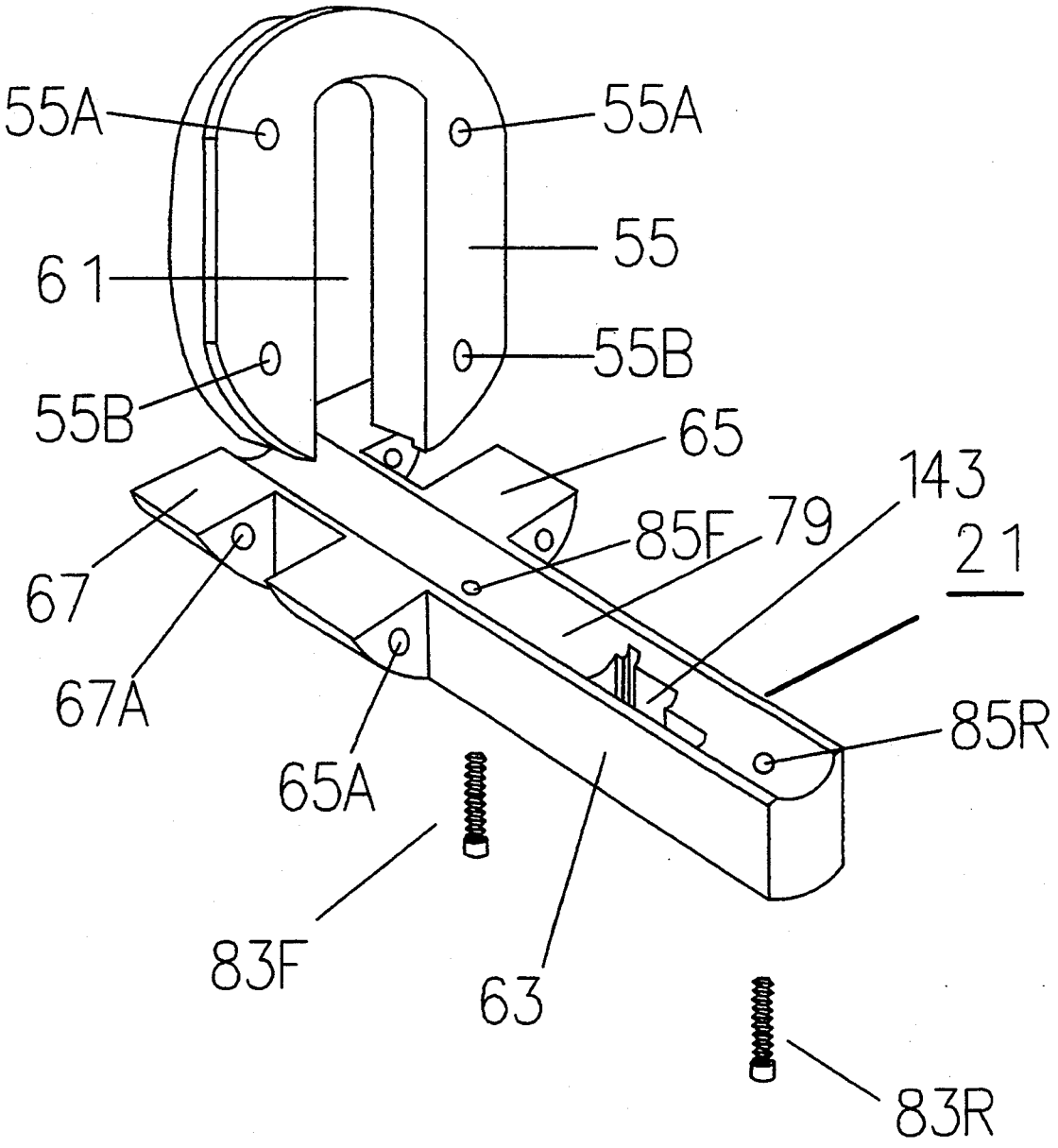
FIG. 12 illustrates the rear adapter assembly and barrel support member.
Figure 13:
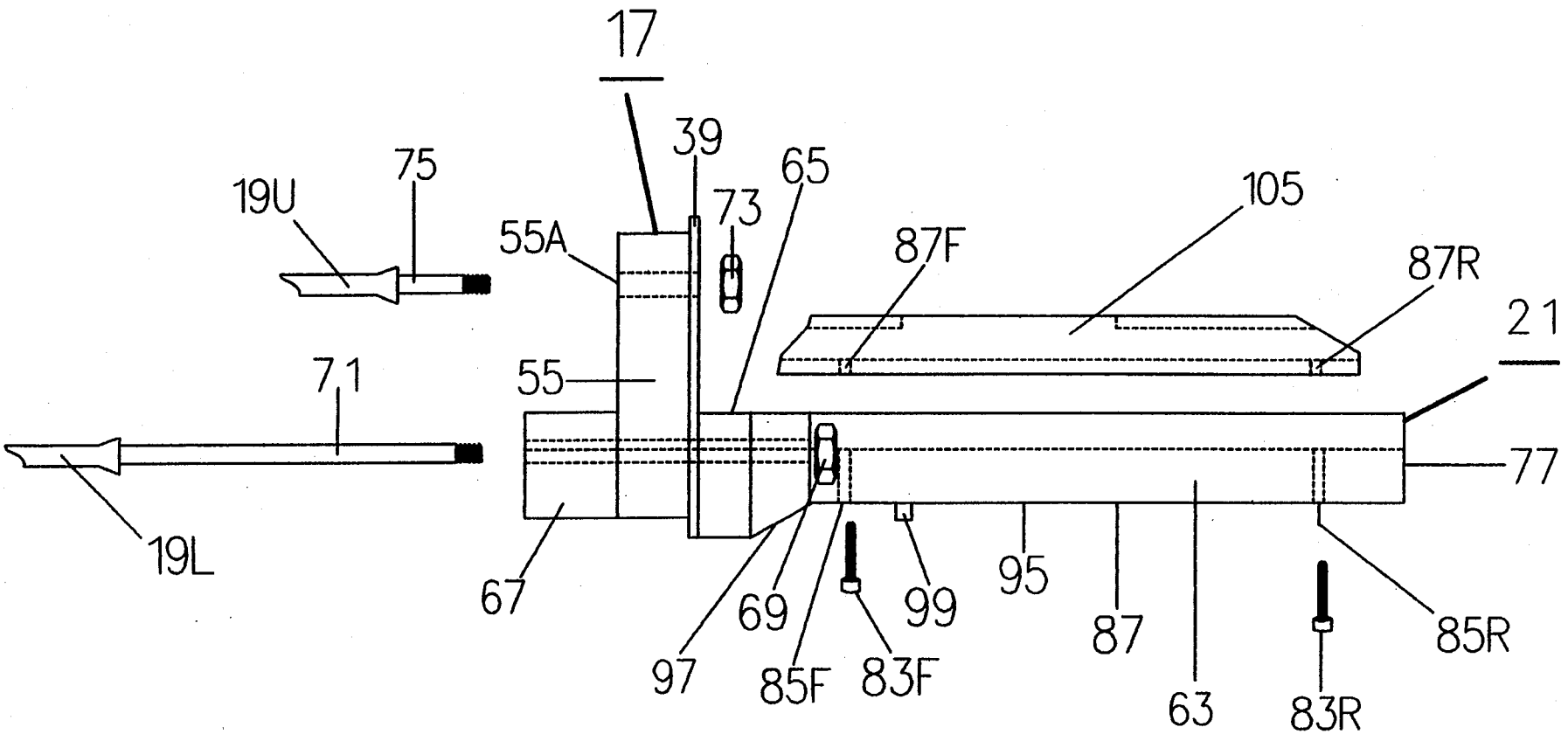
FIG. 13 is a side view of the rear adapter assembly and barrel support member.

The barrel support member 63 extends from the inner adapter coupling member 65 rearward through the inbore plate 55 and the outer adapter coupling member 67 to the rearward end 77 of the breach block stop 21. A barrel channel 79 extends lengthwise through the top 81 of the barrel support member 63. As shown in FIGS. 1, 12 and 13, the rear of the barrel 23 of the device 11 is removably mounted in the barrel channel 79 with front and rear mount screws 83F, 83R that extend through apertures 85F and 85R formed through a rear portion of the member 63 and are screwed into apertures 87F and 87R formed in the receiver 105 to which the barrel 23 is coupled. The barrel channel 79 supports and maintains the barrel 23 in a proper orientation for firing when the barrel 23 is coupled thereto.

Referring now to FIGS. 1, 6, and 8, the bottom 87 of the barrel support member 63 of the breach block stop 21 is designed to co-operatively engage the breach block 33 of the cannon 13. When the device 11 is located in the cannon 13 the barrel support member 63 of the breach block stop 21 is located in the breach ring opening 27 extending adjacent the chamber 31 so that the breach block 33 is prevented from assuming its upward position. The breach block 33 engages and presses against the bottom 87 of the barrel support member 63 as the breach block is urged towards its upward position by the breach block springs. The bottom 87 of the barrel support member 63 is structured to receive and engage the curved surface 89 of the breach block 33. The breach block 33 has a straight portion 91 and a downward tapered portion 93 which engage the bottom 87 of the barrel support member 63 and a tapered portion 97 of the member 65. The pressure applied by the breach block 33 to the bottom 87 of the barrel support member 63 and to the member 65 is used to hold the device 11 in place in the cannon 13.

As shown in FIGS. 1, 6, and 13 an alignment stud 99 extends from the flat section 95 of the bottom 87 of the barrel support member 63 for aligning the device 11 in the cannon 13. The alignment stud 99 fits into a bolt hole 101 in the breach block 33 when the breach block is located engaging the bottom 87 of the barrel support member 63. Location of the alignment stud 99 in the bolt hole 101 aligns the device 11 vertically and ensures that the device 11 is not canted to the left or to the right.

As shown in FIGS. 3 and 4, the adapter support rods 19U and 19L rigidly couple the front adapter assembly 15 with the rear adapter assembly 17 and breach block stop 21. The adapter support rods 19U and 19L have a length sufficient to position the front adapter assembly 15 in the forward portion of the cannon chamber 31 when the rear adapter assembly 17 is located at the rear of the cannon chamber. The adapter support rods 19U and 19L are formed of a rigid structurally sturdy material such as steel to provide structural strength to the frame 12. The adapter support rods 19U and 19L are spaced apart to allow the barrel 23 and the telescopic sight 25 of the device 11 to extend between the rods 19U and 19L. The rods 19U and 19L may be coupled to front and rear adapter assemblies 15 and 17 of different sizes.

Figure 7:
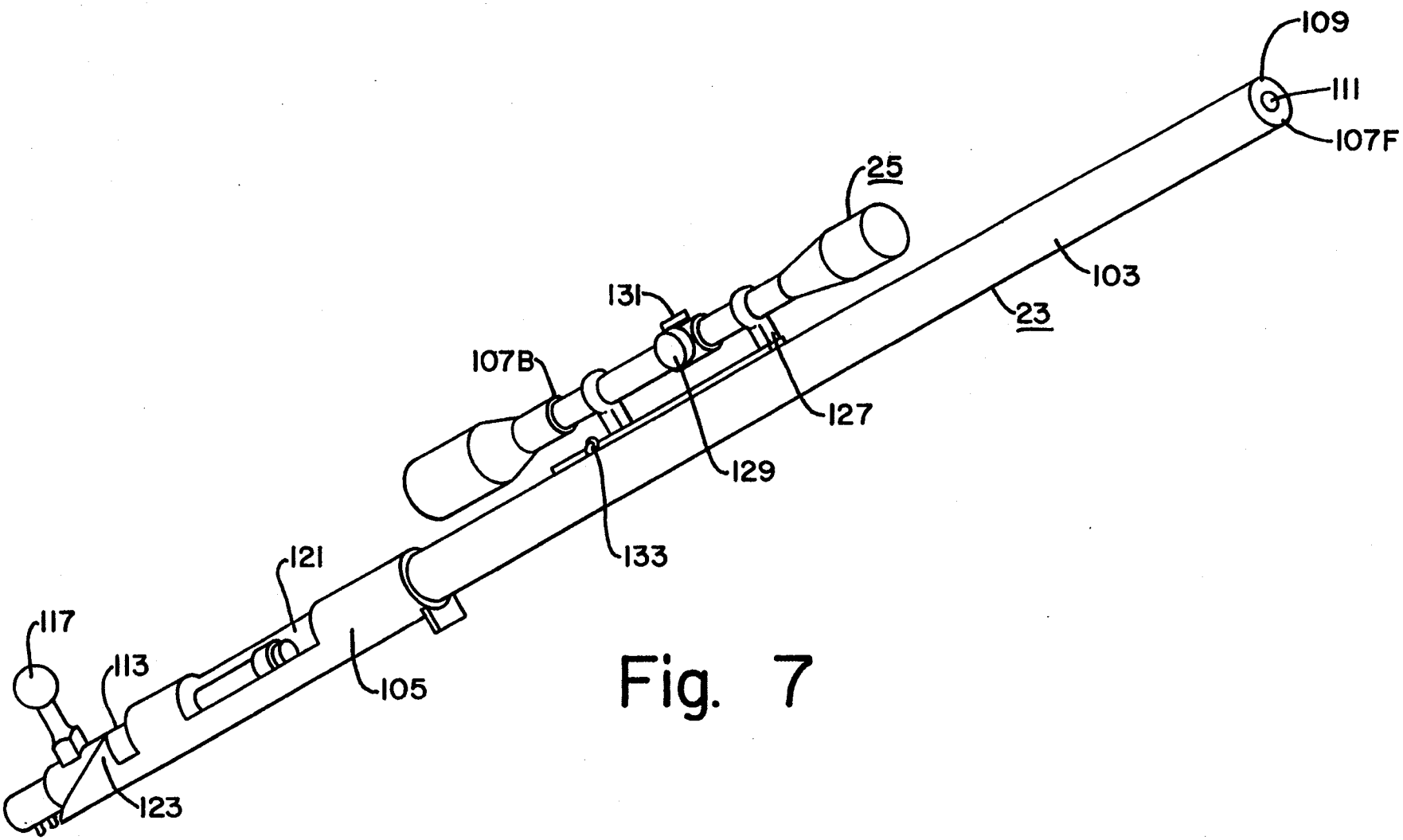
FIG. 7 is a frontal isometric view of the barrel and telescopic sight of the sub-caliber inbore device.

Referring to FIG. 7, the barrel 23 and telescopic sight 25 of the device 11 are shown. The barrel 23 is comprised of a barreled action 103 and a receiver 105. The barreled action 103 is coupled to the receiver 105 at the breech end 107B of the barreled action. The muzzle 109 of the barreled action 103 is located at the forward end 107F of the barreled action. A bore 111 through which ammunition may be fired extends through the barreled action 103 and extends out of the muzzle 109. The device 11 may be provided with barrels 23 having different sized bores 111 where each barrel 23 is coupled to a receiver 105 capable of firing ammunition corresponding to the caliber of the bore 111 of the barrel 23 so that the caliber of the device may be changed by selecting an appropriate barrel 23 and receiver 105. The barrel 23 may be removed from the device by loosening the front and rear mount screws 85F and 85R that mount the receiver 105 and barrel channel 79 of the barrel support member 63. In a preferred embodiment, the barreled action is a Remington Model 700 with target barrel, but McMillan and Sako and other barreled actions may also be used.

Figure 9:
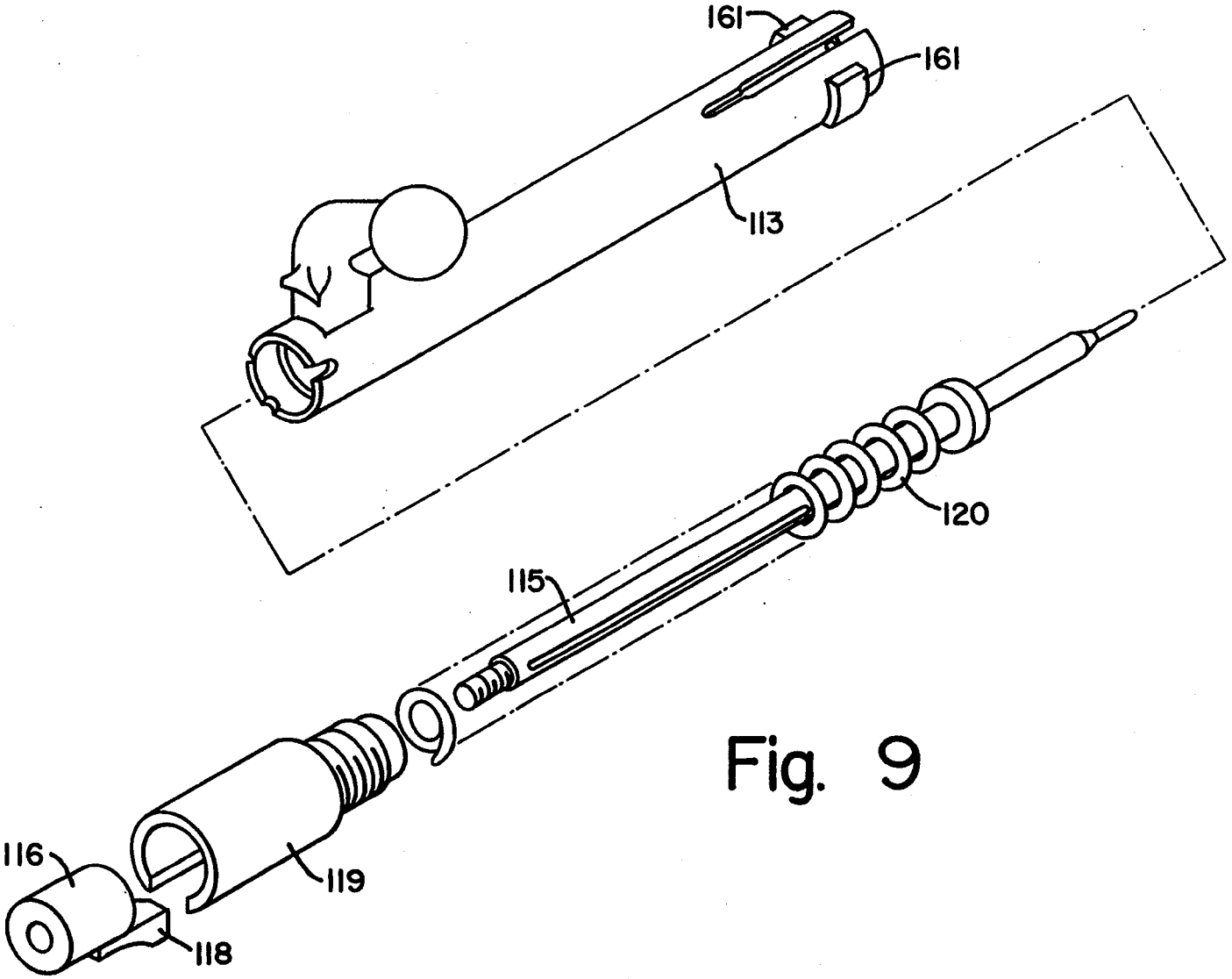
FIG. 9 is a rear isometric view of the bolt and the firing pin of the barrel of the device.
Figure 10:
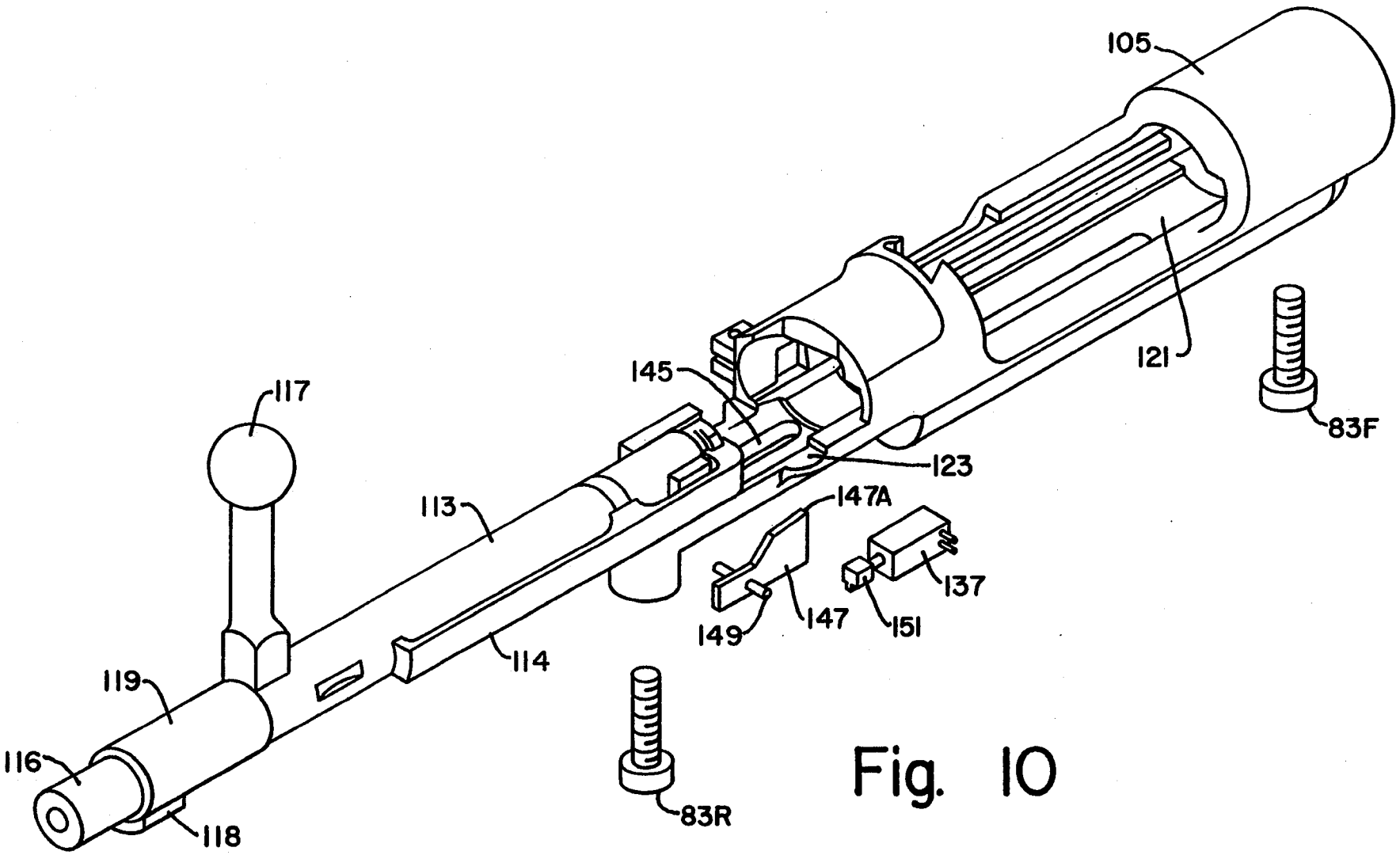
FIG. 10 is a rear isometric view of the receiver, bolt and solenoid of the device.
Figure 11:
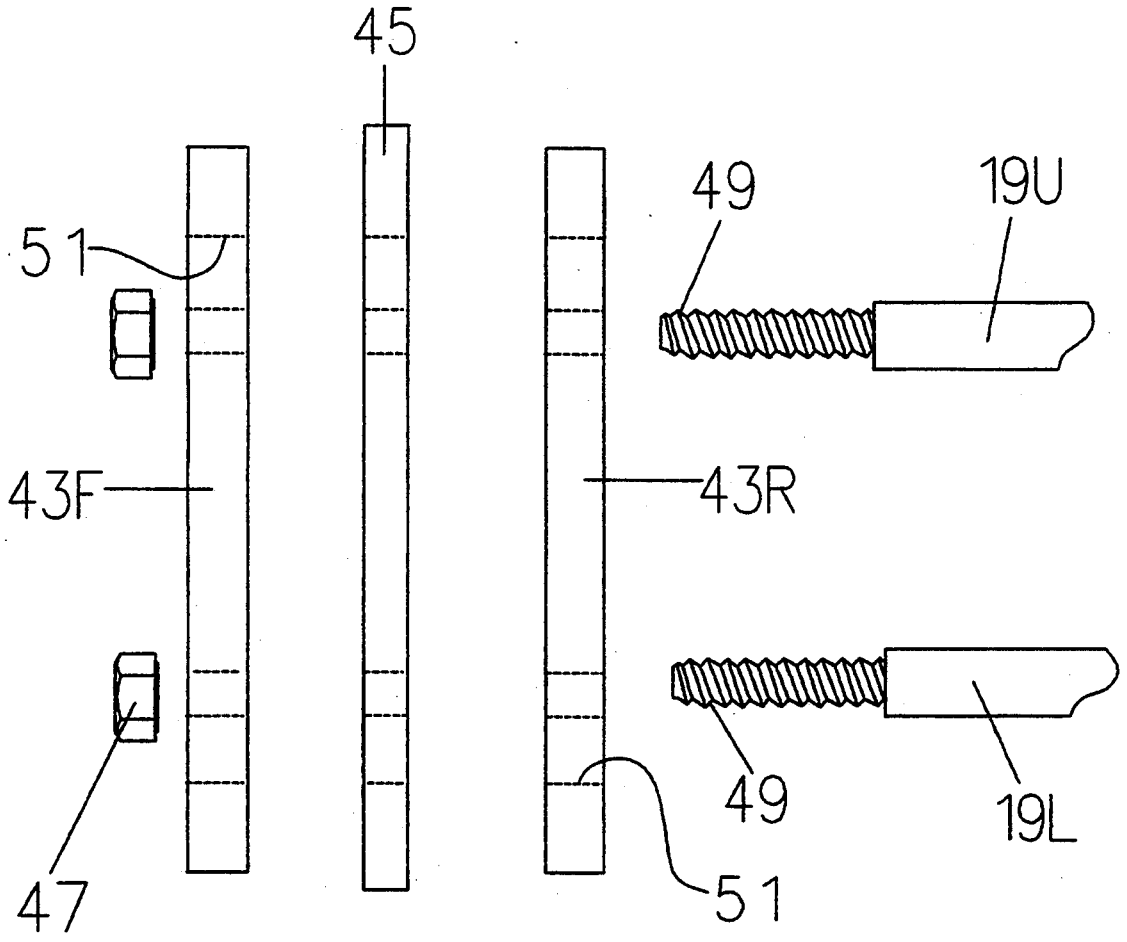
FIG. 11 illustrates the front adapter plate and connecting rods.

The receiver 105 couples the barreled action 103 and houses the bolt 113 of the barreled action 103. As shown in FIGS. 6, 9 and 10, the bolt 113 includes the firing pin 115 of the barreled action 103, a bolt handle 117, and a rear bolt member 119. Referring back to FIG. 7, a cartridge chamber 121 is located in the receiver 105 for housing the bolt 113. The bolt 113 is slidably mounted in the receiver 105 so that the bolt may be slid substantially out of the cartridge chamber 121 for loading of cartridges into the cartridge chamber or extraction of fired cartridges from the cartridge chamber. A bolt catch 123 is located at the rear of the receiver 105 for locking the bolt 113 and firing pin 115 into a position to fire ammunition located in the barrel 23. The front and rear barrel mount screws 83F and 83R extend through front and rear apertures 85F and 85R in the barrel support member 63 and screw into apertures 87F and 87R for mounting the receiver 105 and barrel 23 to the breach block stop 21.

As shown in FIGS. 9 and 10, an extractor 114 fits to the bolt 113 which hooks onto the rim of the cartridge and extracts it from the chamber when the bolt and the extractor are moved to an open position. A firing pin retainer 116 is screwed to the rear of the firing pin 115 through rear bolt member 119 and the rear bolt member 119 is screwed into the rear of the bolt 113.

The retainer 116 has a catch 118 at its lower end. When the bolt 113 is moved into the cartridge chamber 121, the catch 118 is located above a slot 145 formed in the bottom of the receiver and engages a catch 147A of a trigger sear 147 which is pivotally coupled to the receiver by a pin 149. The upper end of the catch 147A is located in the slot 145. A solenoid block 151 engages the bottom of the sear 147 and prevents the catch 147A from moving down and hence prevents the firing pin 115 from moving forward for firing purposes. When the solenoid 137 is actuated, it moves the block 151 forward and releases the catch 147A and hence the firing pin for firing purposes.

When the bolt 113 is rotated 90 degrees counter-clockwise by the handle 117 as shown in the drawings, the lugs 161 are rotated 90° counter-clockwise for release purposes, and the firing pin 115 is cocked by the spring 120. The retainer 116 does not rotate relative to the extractor 114 but slides with the bolt 113 when the bolt is moved forward and rearward.

The block 151 of the solenoid normally is located in a rearward position, such that when the bolt 113 is rotated opened (counter-clockwise), it slips under the sear 147 to hold the catch 147A when the firing pin is cocked by rotating the bolt (counter-clockwise). A sear access aperture 126 (See FIG. 6) is provided in the rear of the breach block stop 21. The sear access aperture 126 provides access to the solenoid block 151 to manually fire the device by pushing the solenoid block 151 forward, or to relieve the spring tension on the firing pin 115 for storage. The receiver and bolt of FIGS. 9 and 10 are a Mauser style bolt action receiver which allows the solenoid 137 and block 151 to release the sear 147.

The solenoid 137 is electrically actuated and may be coupled to the firing system of the cannon 13 when the device 11 is located in the cannon. As described above, the firing mechanism is a spring loaded firing circuit which is activated by the solenoid 137. In a preferred embodiment, the solenoid 137 is a 24 volt DC solenoid made by Guardian of Illinois, Model 11. As shown in FIG. 2, the solenoid 137 is coupled to the electric firing circuit contact 139 of the cannon 13 with an alligator clip 141 so that the firing system of the cannon will electrically activate the solenoid to fire the device 11. The solenoid 137 is located in a solenoid cavity 143 (See FIGS. 3 and 4) in the barrel channel 79 of the barrel support member 63 and is internally grounded therein.

Referring to FIGS. 5–7, the features of the telescopic sight 25 are shown. The telescopic sight 25 is mounted to the barrel 23 on a one piece scope base mount 127 and two scope mount rings. The scope base mount 127 is mounted on the barrel 23 with four screws (not shown). A windage knob 129 and an elevation knob 131 on the telescopic sight 25, and windage screws 133 on the scope base mount may be adjusted to zero the device on a target. A reticle 135 is provided in the telescopic sight 25 for zeroing the device 11. In a preferred embodiment the telescopic sight is a Burris 10× power scope with intermediate eye relief.

As shown in FIGS. 1 and 2, when the device 11 is located in the cannon 13 the receiver 105 of the barrel 23 is mounted in the barrel channel 79 of the breach block stop 21 above the breach block 33. The barreled action 103 of the barrel extends into the chamber 31 through the rearward aperture 61 of the rear adapter assembly, and extends through the chamber 31 and into the rifled cannon bore 35 through the forward aperture 51 of the front adapter assembly. The barreled action 103 extends through the cannon chamber 31 between the spaced apart adapter support rods 19U and 19L. The receiver 105 and the bolt 113 of the barrel 23 are located in the breach ring opening 27 so that the bolt may be manually cycled for loading of ammunition and extraction of fired cartridge casings through the breach ring opening 27. The telescopic sight 25 is located in the cannon chamber 31 on the barrel 23 between the front and rear adapter assemblies 15 and 17 near the rear adapter assembly 17 so that the telescopic sight 25 may be utilized while in the chamber. The telescopic sight 25 is aligned on the barrel within the chamber 31 to allow zeroing of the device 11 through the forward and rearward apertures 51 and 61.

In order to operate the device 11, the device is initially pre-zeroed to a point of impact prior to installation in the cannon chamber 31. Pre-zeroing is accomplished by adjusting the windage knob 129 and the elevation knob 131 of the telescopic sight 25, and occasionally the windage screws 133 of the scope base mount 127, so that the device 11 is zeroed on a target.

After pre-zeroing, the device 11 is located in the cannon 13. The device 11 is inserted into the cannon 13 through the breach ring opening 27 with the breach block 33 located in its downward position. The device is inserted into the cannon 13 so that the rubber bushing 45 of the front adapter assembly 15 is firmly located in the forward portion of the cannon chamber 31, the flanged portion 39 of the rear adapter assembly 17 is located against the chamber end wall 41, and the alignment stud 99 is located in position to be received by the hole 101 in the breach block 33. The breach block 33 is then allowed to engage the device 11 and hold the device in the cannon chamber 31.

The device 11 may then be set up to fire in conjunction with the cannon firing system. The alligator clip 141 attached to the solenoid 137 is connected to the firing contact 139 of the cannon 13 so that the cannon firing control will cause the device to fire. The device is boresighted to correspond to the cannon sights by locating the crosshairs of the reticle 135 of the telescopic sight 25 on a distant aiming point and then sighting the cannon sights on the same distant aiming point.

Ammunition is loaded into the device 11 through the breach ring opening 27 of the cannon 13. The bolt 113 may be slid substantially out of the cartridge chamber 121 to allow insertion of ammunition into the cartridge chamber 121. After ammunition is located in the barrel 23, the bolt 113 is slid back in to the cartridge chamber 121 into a firing position. The device may then be fired. The spent ammunition cartridge may be recovered by sliding the bolt back out of the bolt chamber and removing the cartridge.

The device may be removed from the cannon chamber 31 simply by disconnecting the alligator clip 141 from the cannon firing contact 139 and pulling the device out of the chamber. If the device becomes stuck in the chamber 31, the device may easily be removed from the chamber by using a conventional cartridge extractor on the flanged portion 39 of the rear adapter assembly 17.

The foregoing disclosure and the showings made in the drawings are merely illustrative of the principles of this invention and are not to be interpreted in a limiting sense.

I claim:

1. An inbore sub-caliber device adapted to fit in a chamber of a cannon through a breech opening in said cannon, comprising:

spaced apart front and rear members, each of said members having an opening formed therethrough, a plurality of spaced apart rods extending between and secured to said front and rear members to locate said openings of said front and rear members in alignment, a support structure coupled to said rear member, a gun comprising an elongated barrel having a front end and a rear end and a receiver secured to said rear end of said barrel for use for holding and firing a bullet through said barrel, means for securing said gun to said support structure for supporting said barrel in alignment with said openings of said front and rear members with at least a portion of said receiver located rearward of said rear member and said front end of said barrel located forward of said rear member to allow a bullet when fired to pass from said front end of said barrel by way of said opening of said front member, means for securing said members and said barrel in said chamber of said cannon with said front member and said front end of said barrel extending to a forward portion of said chamber and with said receiver being accessible by way of said breach opening for allowing one to locate a bullet in said receiver and to fire said gun.

2. The inbore sub-caliber device of claim 1, wherein:

said plurality of spaced apart rods are removably secured to said front and rear members to allow said front and rear members to be interchanged with other front and rear members of different size, respectively, for adapting said device to a cannon of different caliber;

said support structure is removably coupled to said rear member.

3. The inbore sub-caliber device of claim 1, wherein:

said gun has a given caliber, said means for securing said gun to said support structure removably couples said gun to said support structure to allow said gun to be interchanged with a gun having a different caliber.

4. The inbore sub-caliber device of claim 1, wherein:

a telescopic sight is mounted to said barrel of said gun located forward of said rear member to allow said gun to be zeroed on a target.

5. The inbore sub-caliber device of claim 4, wherein:

said plurality of spaced apart rods are removably secured to said front and rear members to allow said front and rear members to be interchanged with other front and rear members of different size, respectively, for adapting said device to a cannon of different caliber;

said support structure is removably coupled to said rear member;

said gun has a given caliber;

said means for securing said gun to said support structure removably couples said gun to said support structure to allow said gun to be interchanged with a gun having a different caliber.

* * * * *